US006207941B1

(12) United States Patent
Schmidt et al.

(10) Patent No.: US 6,207,941 B1
(45) Date of Patent: Mar. 27, 2001

(54) METHOD AND APPARATUS FOR RAPID DRYING OF COATED MATERIALS WITH CLOSE CAPTURE OF VAPORS

(75) Inventors: Philip S. Schmidt; John H. Davis; Tyler Blessing, all of Austin, TX (US)

(73) Assignee: The University of Texas System, Austin, TX (US)

( * ) Notice: Subject to any disclaimer, the term of this patent is extended or adjusted under 35 U.S.C. 154(b) by 0 days.

(21) Appl. No.: 09/354,896

(22) Filed: Jul. 16, 1999

Related U.S. Application Data

(60) Provisional application No. 60/093,113, filed on Jul. 16, 1998, and provisional application No. 60/093,509, filed on Jul. 21, 1998.

(51) Int. Cl.[7] ..... H05B 6/64; H05B 6/70; H05B 6/80

(52) U.S. Cl. ..... 219/690; 693/750; 34/420

(58) Field of Search ..... 219/750, 690, 219/696, 693, 746, 698–701, 756; 34/259, 418, 419, 420, 421, 624

(56) References Cited

U.S. PATENT DOCUMENTS 3,672,066 * 6/1972 Stephansen ..... 34/265
3,673,370 * 6/1972 Johnson ..... 219/693
3,999,026 * 12/1976 Boling ..... 219/693
4,149,322 * 4/1979 Minoda et al. ..... 34/4
4,259,560 * 3/1981 Rhodes ..... 219/678
5,319,861 * 6/1994 Tate ..... 34/267
5,536,921 * 7/1996 Hedrick et al. ..... 219/693
5,606,805 * 3/1997 Meyer ..... 34/421
5,981,022 * 11/1999 Min et al. ..... 428/98

* cited by examiner

*Primary Examiner*—Teresa Walberg
*Assistant Examiner*—Jeffrey Pwu
(74) *Attorney, Agent, or Firm*—Conley, Rose & Tayon, PC; Eric B. Meyertons

(57) ABSTRACT

A method and apparatus for the removing solvents from coated materials while capturing evaporated vapors in a confined space and maintaining non-explosive conditions within the space. Microwave energy may be applied to a coated material as the coated material passes through a cavity configured to produce an electromagnetic resonance mode. The application of microwaves to the coated material causes rapid evaporation of the solvents. The cavity is also configured to confine the evaporated vapors in a small volume and control the inflow of air into the volume so as to produce an effluent waste stream which includes a relatively high concentration of solvent molecules while maintaining a non-explosive atmosphere within the cavity. The method and apparatus are particularly suited for treating coated web materials, especially continuous webs.

69 Claims, 5 Drawing Sheets

METHOD AND APPARATUS FOR RAPID DRYING OF COATED MATERIALS WITH CLOSE CAPTURE OF VAPORS

PRIORITY CLAIM

This application claims the benefit of U.S. Provisional Application Ser. No. 60/093,113 entitled "Method and Apparatus for Rapid Drying of Coated Materials," filed Jul. 16, 1998 and U.S. Provisional Application Ser. No. 60/093,509 entitled "Method and Apparatus for Rapid Drying of Coated Materials," filed Jul. 21, 1998.

BACKGROUND OF THE INVENTION

1. Field of the Invention

The present invention generally relates to a method and device for the rapid drying of coated materials by the application of microwave energy. The invention may be used for the removal of water or organic solvents from coated materials, especially, but not limited to, continuous webs.

2. Brief Description of the Related Art

A variety of industrial products are manufactured in the form of long thin webs which are coated or printed. Examples of these products include wall coverings (e.g., wallpaper), plastic and paper packaging, published materials, textiles, photographic films, plastic transparencies, magnetic media and adhesive tapes. Typically, the coating of these products is performed with the use of a volatile organic compound (VOC) or water. Examples of VOCs that may be used in these processes include methyl ethyl ketone, acetone, toluene, alcohols, and chlorinated solvents. After the web material has been processed, the solvent used is typically removed, thus leaving the desired coating or printing on the web. The removal of these solvents from web materials is typically accomplished through a heating process.

All manufacturers of printed and coated web products are strongly affected by new provisions of the Clean Air Act, which mandate strict controls on the emission of VOCs to the atmosphere. The costs for a VOC emission control system tend to be strongly dependent on the degree of dilution of VOCs in an air stream. Since coated web material is conventionally dried by exposure to hot air streams, air dilution of the VOCs is normally inherent in the drying process. This dilution tends to create large volumes of air which typically need to undergo treatment before the air is released into the atmosphere.

Contaminated air streams are typically treated by either incineration or passage of the air through an adsorbent material. In a typical incineration procedure, the stream is heated to about 600° C. to decompose the VOCs. If the concentration of organics is too dilute, natural gas is typically added such that sufficient combustion may be achieved. It is therefore desirable that the stream of organic contaminants be concentrated before incineration, to lower the amount of additional fuel needed to effect destruction of organics. The use of an air stream with a higher concentration of VOCs requires less additional fuel and, therefore, less overall cost.

Alternatively, adsorbent materials may be used to remove the VOCs from the air. The contaminated air stream may be transferred to an adsorbent column. As the contaminated stream is passed through the column, the VOCs are removed. After the process is completed or when the adsorbent materials become saturated, the VOCs are typically removed from the adsorbent. The purification of the adsorbent is typically accomplished by heating the adsorbent materials to remove the VOCs from the adsorbent material. The removal of the VOCs from the adsorbent tends to be performed such that the VOCs are removed to form an air or inert gas stream containing a relatively high concentration of VOCs. An air or inert gas stream containing a relatively high concentration of VOCs is typically more economical to treat.

An alternate method of treatment of contaminated streams is by recovery of the VOCs from the air stream. To recover the VOCs, the air stream is typically passed through a cooling system which allows the VOCs to condense out of the air stream. The efficiency of recovering solvents in this manner tends to be dependent on the concentration of the VOCs within the air stream. To achieve an economically viable recovery system the VOCs typically need to be relatively concentrated.

In general, water-based coatings, while desirable due to the low toxicity of the solvent, are much harder to evaporate than volatile organic materials. A typical hot air drying system may require seconds to minutes to dry a coated web which has been treated with water. This may require relatively large heating systems which generate large amounts of relatively dilute contaminated air streams. It would be desirable to create a system which would allow a more rapid drying of water-coated web materials, thus creating a more concentrated contaminated air stream.

It is therefore desirable to create a system by which solvents, such as water or VOCs, may be evaporated from coated materials such that the solvents are carried from the materials in an air stream containing a relatively high concentration of the solvent. Additionally, it is further desirable that the drying be accomplished in a relatively short time span. By rapidly drying coated materials to form an air stream containing a relatively high concentration of solvent, both heating costs and waste treatment costs may be reduced.

SUMMARY OF THE INVENTION

The rapid drying of coated or printed materials may be accomplished by the use of microwaves propagated in a resonant chamber. The chamber may provide a uniform irradiation of microwave energy across the coated or printed material or an irradiation pattern tailored to the geometry of the product. In the context of this patent, "microwaves" are defined to be relatively short electromagnetic waves (e.g., electromagnetic waves having a wavelength of less than about one meter).

In an embodiment, a chamber for drying coated materials is formed from a body, a front wall, and a rear wall. The chamber, in one embodiment, has an elongated member made of a non-conductive material disposed in the central portion of the chamber. The body is, in one embodiment, formed from a substantially electrically conductive material. The inner surface of the body may be lined with a layer of an electrically conductive material. This layer of conductive material, in one embodiment, has a higher electrical conductivity than the material used for the body.

The chamber may have at least one slot, preferably two slots, formed in the body of the chamber to allow passage of a coated material. The slots may be oriented such that a coated material may be passed through a portion of the chamber. The slots are also may be configured to allow air to pass into the chamber at a controlled rate so that the concentration of combustible vapors within the chamber is maintained either above the upper explosive limit or below the lower explosive limit. The lower explosive limit is herein defined as the minimum concentration of a flammable gas or vapor in which an explosion may occur upon ignition in a confined area. The upper explosive limit is herein defined as the maximum concentration of a flammable gas or vapor in which an explosion may occur upon ignition in a confined area. Together, the lower and upper explosive limits define a range of concentrations in which an explosion may occur upon ignition.

The elongated member may be configured to be rotatable within the chamber and oriented so as to guide the passage of a coated material through the regions of highest electric field intensity. The elongated member may be positioned in the cavity such that the movement of the coated material against the outer surface causes the elongated member to rotate. In this manner the coated material may be passed through along the outer surface of the elongated member without causing frictional heat or electrostatic charge to build up along the outer surface.

The chamber may include an opening to allow microwave radiation to enter the chamber. The opening may be positioned in the center of the body. The opening may be positioned at any point along the longitudinal axis of the chamber. The opening may be configured to match the size and shape of a waveguide. The opening may be rectangular in shape. The broadwalls of the opening may be orientated perpendicular to the longitudinal axis of the chamber to allow the incoming microwave radiation to have the proper orientation to form the transverse magnetic resonance mode.

The chamber may be formed in two sections. The two sections may be separated to allow access to the interior of the chamber. This provides a convenient means to facilitate threading of the web, cleaning of the cavity, and maintenance of the chamber.

A preferred resonance mode for drying coated materials is a $TM_{110}$ resonant mode. This particular mode has the characteristic that it provides a uniform electric field intensity along the longitudinal axis of the chamber. The intensity of the electric field regions produced by this mode tends to vary between the outer surface of the elongated member and the inner surface of the cavity. Typically, this mode produces an electric field region having a peak intensity at a portion of the outer surface of the elongated member. The strength of the electric field region may decrease as the inner surface of the cavity is approached. In one embodiment, the chamber has a diameter such that the strength of the electric field proximate the inner surface is insignificant. Thus, the chamber may be sized such that the electric field is completely contained within the chamber. This configuration may allow various slots and openings to be formed within the body of the chamber such that no significant leakage of microwave radiation occurs through these openings and provides a convenient means of removing a section of the cavity to facilitate threading of the web, cleaning and maintenance.

The use of a microwave electromagnetic resonant mode, such as the $TM_{110}$ mode, may allow the drying of coated materials. A coated material may be passed through the chamber such that the material passes through the regions of high electric field strength. The electrical energy imparted by these regions may cause the solvent molecules to become heated and evaporated. Since the peak intensity of the electric field is along the surface of the elongated member, the solvents contained within or on the surface of the web may be relatively rapidly heated. The relatively rapid heating of the solvent molecules tends to cause the solvent to evaporate from the coated material.

The cavity may include an opening to allow air to pass out of the cavity, positioned so as to rapidly remove vapor from areas of highest vapor concentration within the cavity. A conduit may be coupled to the opening, the conduit leading to an air removal system. The air removal system is, in one embodiment, designed to pull air away from the chamber and into an air treatment system. The air removal system may include a blower which draws air from the chamber. The fan, in one embodiment, pulls air from the cavity through the opening and into a conduit. Once in the conduit, the air stream may be conducted to an air treatment system.

The chamber and the coated material entrance and exit slots may be sized to maximize the concentration of the solvent in the effluent air stream. During a typical procedure, air is passed through the slots, across the drying coated material and out the opening. By controlling the flow rate, the concentration of solvent contained in the air may be maximized. By maximizing the concentration of solvent within the effluent air stream, the solvents may be removed from the air stream by recovery of the solvents rather than through a destructive abatement process, or, alternatively, may be incinerated with little or no supplemental fuel.

When the coated material is a continuous web material, the input and output angles of the web may be controlled to allow the web to pass through the region of highest electrical field strength. This arrangement may allow the maximum amount of electrical energy to be imparted to the web material as it passes through the chamber.

The chamber, as described above, may be capable of producing a resonant mode having a relatively high stored energy level. In one embodiment, the power is set such that a steady state may be achieved whereby the amount of energy removed by the web is replaced by the incoming energy such that the energy of the system remains relatively constant.

A microwave drying system, in one embodiment, includes a microwave generator for generating microwave radiation. The microwave generator may include a controller for varying the output power of the generator. The controller may be used to select the appropriate output power of the microwave generator. In another embodiment, the microwave generator may be specially designed to produce microwave radiation having the desired power.

In another embodiment, the microwave generator may produce microwave radiation at the appropriate power level without the need of a power regulation system. The microwave generator may be connected directly to the drying chamber.

In another embodiment, the microwave generator feeds directly into the drying chamber without passing through a waveguide.

The system may include a microwave energy sensor which measures the power of the microwave radiation transmitted forward to the chamber and reflected in the waveguide. The energy sensor may be connected to an automatic control system so that the control system varies (tunes) the power of the microwave radiation as a function of the information received from the microwave energy sensor. In one embodiment, a series of ferrite rods are positionable within the waveguide to vary the energy of the microwaves passing through waveguide.

A system for drying a continuous coated web material, in one embodiment, includes a feed roller, a collection roller, a chamber for drying the web and a microwave generator. The microwave generator may be coupled to the drying chamber via conduit. The feed roller may hold the coated web material which is to be treated. The collection roller may hold the dried coated web material. The collection roller may be attached to a motor which rotates the collection roller to move the web material through the drying chamber.

A microwave drying system may be used to dry a coated material. A variety of coated materials may be dried with the system described above, including but not limited to wall coverings (e.g., wallpaper), plastic and paper packaging, published materials, textiles, photographic films, plastic transparencies, adhesive tapes, transfer print paper, magnetic media and semiconductor materials.

In a typical procedure the microwave generator is turned on and the microwaves are introduced into the chamber such that an electromagnetic resonant mode is, in one embodiment, produced within the chamber. In one embodiment, a transverse magnetic mode is produced; preferably, a $TM_{110}$ mode is produced. The microwave generator may have to be tuned in order to produce microwaves having the appropriate power to produce the desired resonance mode at the operating frequency of the generator.

After the appropriate resonance mode has been set up, the web material may be passed through the chamber. The web may be pulled through the chamber by rotation of the collection roller. The rate at which the web material passes through the material may be controlled by the automatic controller.

The evaporated solvent may be contained within the cavity after the solvent is removed. An air intake system may be connected to the chamber such that the air within the chamber is drawn toward the air intake system. In one embodiment, the air intake system includes a fan. The contaminated air stream is then may be passed through the air intake system and into an air treatment system.

In another embodiment, a silicon wafer or other coated materials may be placed within the chamber prior to introducing microwaves into the chamber. After the chamber has been closed the microwave generator may be turned to produce the resonant mode within the cavity. The silicon wafer may be placed upon the elongated member. The wafer may be rotated such that the entire wafer passes through the strongest portion of the electric field. This drying process may also be used for the drying of sheet fed paper in printing or copying devices.

DETAILED DESCRIPTION OF PREFERRED EMBODIMENTS

The relatively rapid drying of coated or printed materials may be accomplished by the use of microwaves of large amplitude contained in a resonant chamber. The chamber, in one embodiment, provides a substantially uniform irradiation of microwave energy across a portion of a cavity defined by the chamber geometry and the geometry and dielectric properties of the elongated member. While providing this uniform irradiation, the chamber may be designed to allow passage of a web material into and out of the cavity. The chamber is also designed to allow removal of vapor from the chamber without substantial leakage of microwaves from the chamber. The chamber may serve as a confining space to trap the evaporated solvent. The solvent may be exhausted from the chamber into a collection system or a destructive abatement device.

The chamber is configured to take advantage of the property of microwave energy to selectively excite molecular motion in polar compounds, such as water and most organic solvents. This selective excitement of the solvent molecules may cause the solvent to become heated with little or no heating effect on the substrate. The microwaves may produce rapid evaporation of the solvent from the coated material. A wide variety of coated materials may be treated in this manner. Examples of coated materials which may be dried by the application of microwaves include but are not limited to wall coverings (e.g., wallpaper), plastic and paper packaging, published materials, textiles, photographic films, plastic transparencies, adhesive tapes, magnetic media, transfer print paper, and semiconductor materials.

Figure 1:
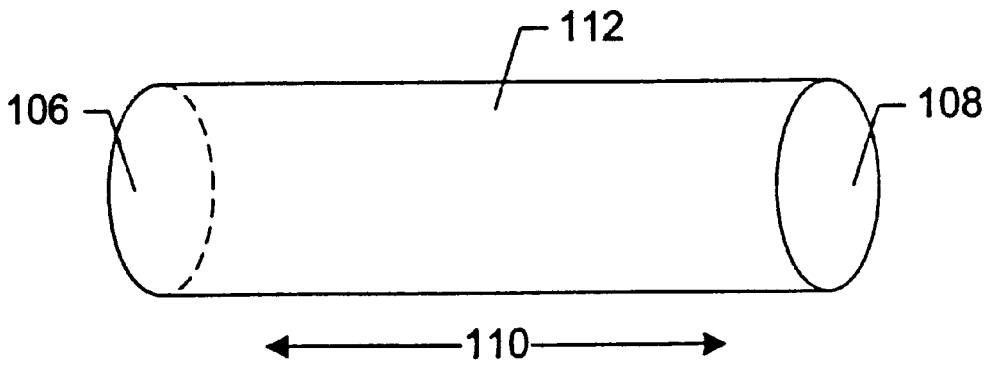
FIG. 1 depicts a view side view of a cylindrical chamber.

The chamber is designed such that a large resonant electromagnetic mode is, in one embodiment, produced when microwaves are introduced into the chamber. In one embodiment, a TM resonant mode is produced within the chamber. A "TM mode" refers to a resonant mode which includes only a magnetic field vector transverse to the axis of the cylindrical cavity. In using a cylindrical cavity, as is depicted in FIG. 1, the direction in which the microwave fields are uniform is in a direction 110 along the longitudinal axis of the cavity (i.e., between side walls 106 and 108). All electromagnetic radiation (e.g., microwave radiation) is made up of an electric component and a magnetic component oriented perpendicular to each other. In a TM resonant mode, the magnetic field component of the microwave radiation is perpendicular to the longitudinal axis of the cavity. The electric field component of the microwave radiation is oriented perpendicular to the magnetic field component. In the cylinder depicted in FIG. 1, the electric field extends between the two sidewalls 106 and 108 throughout the chamber. This orientation, it is believed, creates an electric field having a strength which is uniform along any longitudinal axis of the cylinder.

Figure 2:
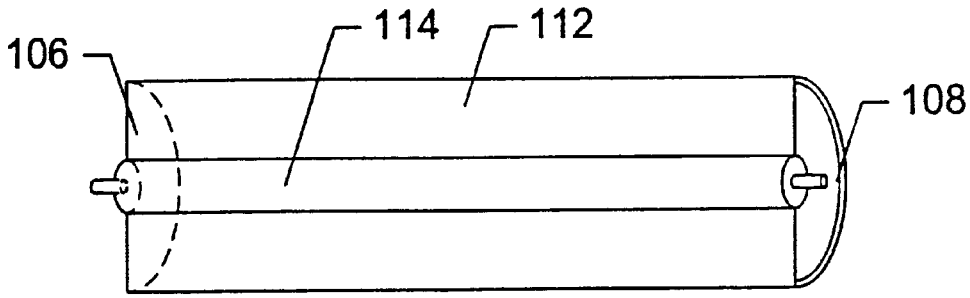
FIG. 2 depicts a cross sectional view of a cylindrical chamber.

In an embodiment, a chamber for drying coated materials is formed from a body 112, a front wall 106, and a rear wall 108, as depicted in FIGS. 1 and 2. The chamber, in one embodiment, has an elongated member 114 made of a low loss dielectric material disposed in the central portion of the chamber, as depicted in FIG. 2. In an alternate embodiment the elongated member 114 is not present. While depicted as cylindrical, it should be appreciated that the chamber may be formed in a number of cross-sectional shapes including, but not limited to, hexagonal, elliptical, oval, and rectangular. The body 112 is, in one embodiment, formed from a substantially conductive material such as a metal. Examples of conductive materials include but are not limited to aluminum, tin, copper, silver and gold. In one embodiment, the body 112 is formed from aluminum. The inner surface of the body 112 may be lined with a layer of a conductive material. This layer of conductive material, in one embodiment, has a higher conductivity than the material used for the body 112. In general, the conductivity of the material determines how efficiently that material will reflect microwaves. The use of a highly conductive inner surface allows efficient reflection of the microwave energy by the walls of the cavity.

Figure 3:
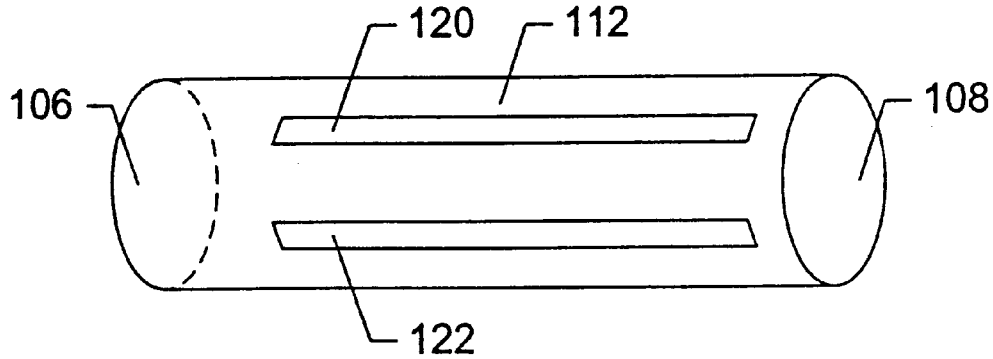
FIG. 3 depicts a side view of a cylindrical chamber with slots.

The chamber, in one embodiment, has at least one slot 120 formed in the body 112 of the chamber to allow entrance and egress of a coated web material. In one embodiment, two slots 120 and 122 are formed in the body of the chamber, as depicted in FIG. 3, to allow passage of a web material. The slots 120 and 122 are oriented such that a web material may be passed through a portion of the chamber. The slots 120 and 122 are also configured to allow air to pass into the chamber.

Figure 5:
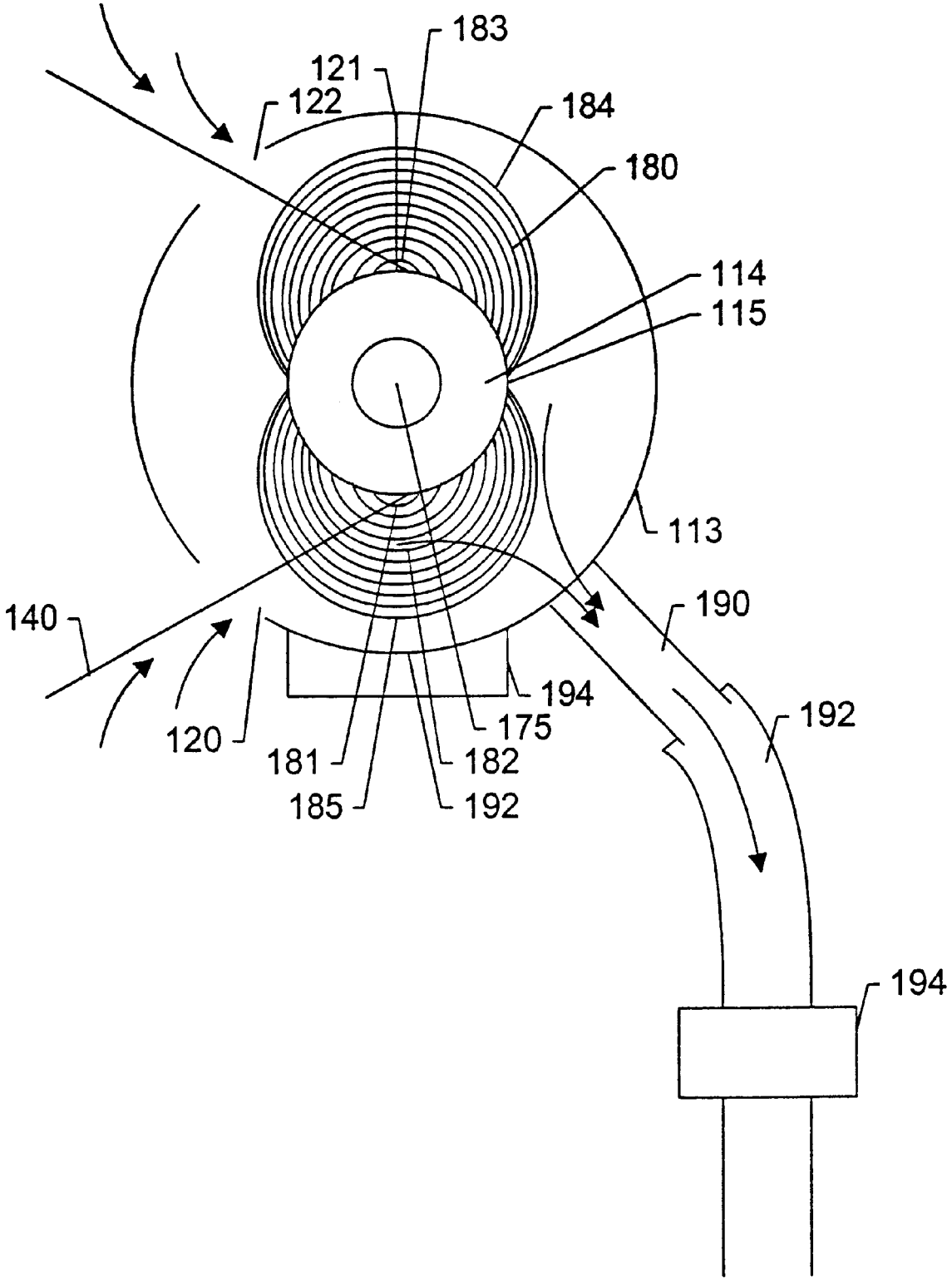
FIG. 5 depicts a cross-sectional view of a chamber, viewed along the longitudinal axis of the chamber.

The coated material 140 may enter the chamber through entrance slot 120, as depicted in FIG. 5. The coated material 140 passes into the chamber through slot 120 and is passed around the elongated member 114. The coated material then exits the chamber through exit slot 122. In this manner, the material travels in a path through the chamber. In another embodiment, the slots may be oriented such that the web material may be passed through the chamber such that the web follows a substantially straight path (in this embodiment elongated member 114 may or may not be present). Slots 120 and 122, in one embodiment, have a width that is slightly larger than a thickness of the coated material. The slots, in one embodiment, have a width and length which will allow free passage of a coated material into and out of the chamber. To assure safety of operation, the air flow rate through the slots may be controlled by selection of the slot width and the exhaust blower so as to maintain the concentration of combustibles in the chamber either above the upper explosive limit or below the lower explosive limit.

Figure 4:
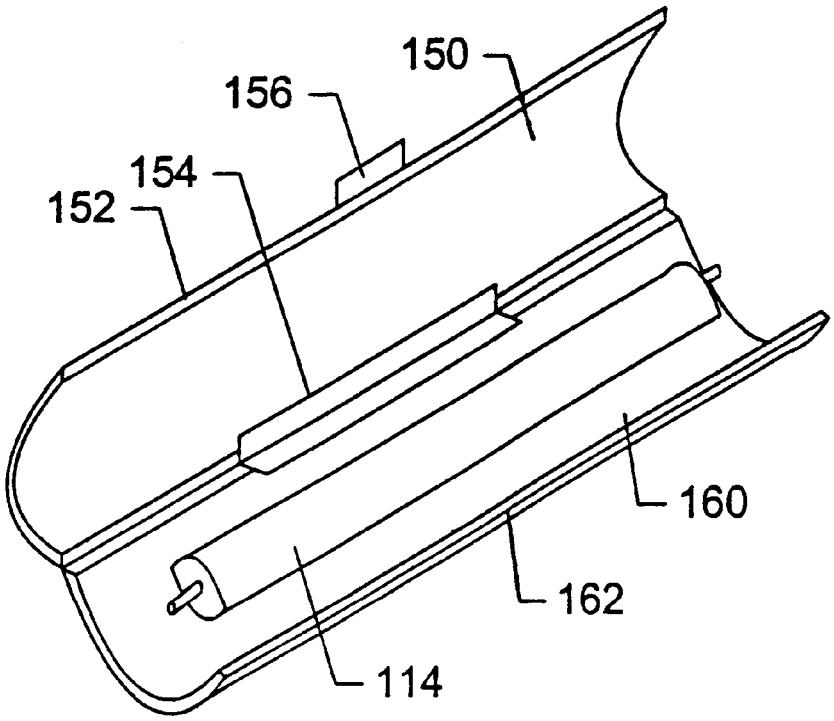
FIG. 4 depicts a perspective view of an open chamber.

The chamber is, in one embodiment, designed to allow access to the interior of the chamber. To facilitate this access, the chamber may be constructed of an upper portion 150 and a lower portion 160, as depicted in FIG. 4. The upper portion 150 and lower portion 160 may be partially separated to allow access to the interior of the chamber. The elongated member 114 is, in one embodiment, attached to the lower portion 160. In an embodiment, the upper portion 150 may be removed from the lower portion to allow access to the interior. In another embodiment, the upper portion 150 and lower portion 160 are connected together by a connector 154.

Connector 154 may be positioned along the longitudinal axis of the chamber. The connector 154 is, in one embodiment, placed on the rear portion of the chamber. The connector 154 may act as a hinge that allows the upper portion 150 to be rotated away from the lower portion 160, such that the front edge 152 of the upper portion is rotated away from the front edge 162 of the lower portion. An fastener 156 may be placed on the front edge 152 of the upper portion 150 to secure the upper portion to the lower portion 160 when the chamber is closed. In another embodiment the upper portion 150 may be removable from the lower portion 160. A pair of fasteners may be attached to the front and rear edges of the upper portion or the lower portion to secure the upper portion to the lower portion when the upper portion is placed upon the lower portion.

An elongated member 114 is, in one embodiment, oriented in a central portion of the chamber, as depicted in FIGS. 2 and 4. In one embodiment, the elongated member 114 is positioned along a longitudinal axis which passes through the center of the chamber. The elongated member 114 is, in one embodiment, made of a non-conductive material. In one embodiment, the elongated member is made of a material having a low loss dielectric constant. Some examples of materials that have these properties, and thus may be used to form the elongated member, include polytetrafluoroethylene (e.g., TEFLON), quartz (3.75), duroid (9.8),polytetrafluoroe thylene (TEFLON, the dielectric constant is 2.1),polyethylene (2.3), polyisobutylene (2.2), pyroceram (e.g., Dow Corning Pyroceram 9090), polychlorotrifluoroethylene (2.8), polystyrene (2.5) and various rubbers (2.4–2.9). It should be understood that any substantially rigid material having a low loss dielectric constant less than about 3 may be used to form the elongated member. The elongated member is, in one embodiment, made of a non-conducting material whose dielectric properties are selected in order to help create and stabilize a TM resonant mode.

The elongated member may be configured to be rotatable within the chamber. The elongated member may be positioned in the cavity such that the movement of the coated material against the outer surface causes the elongated member to rotate. In this manner the coated material may be passed along the outer surface of the elongated member without causing frictional heat to build up along the outer surface.

In one embodiment, where the chamber is cylindrical, a diameter of the cavity defined by the chamber is, in one embodiment, near a first minimum in magnitude of the radial Bessel Function which satisfies the boundary conditions at the center of the cavity and the outer edge of the elongated member. When the chamber is cylindrical, the elongated member is, in one embodiment, cylindrical also. The diameter of the elongated member may be chosen based on the dielectric constant of the elongated member material and the diameter of the cavity. For a elongated member made of polytetrafluoroethylene residing in a cylindrical chamber having a diameter determined by the radius at which the radial Bessel Function which satisfies the boundary conditions at the center of the cavity has a maximum in magnitude. In an embodiment in which there is a steel shaft in the center of the elongated member, the radial Bessel functions boundary condition must be satisfied at the edge of the rigid member (175). When configured in this manner the chamber will, in one embodiment, produce a $TM_{110}$ resonance mode at a significantly greater magnitude than the other modes when the cavity is irradiated with microwave radiation. Other resonant modes, such as $TM_{010}$, $TM_{210}$, $TM_{120}$, may be produced by varying the dimensions and shape of either the cavity, the elongated member, or both. If the material which the elongated member is composed of is changed the diameter of the elongated member is, in one embodiment, altered to produce a maximum field strength at the outer edge.

Figure 6:
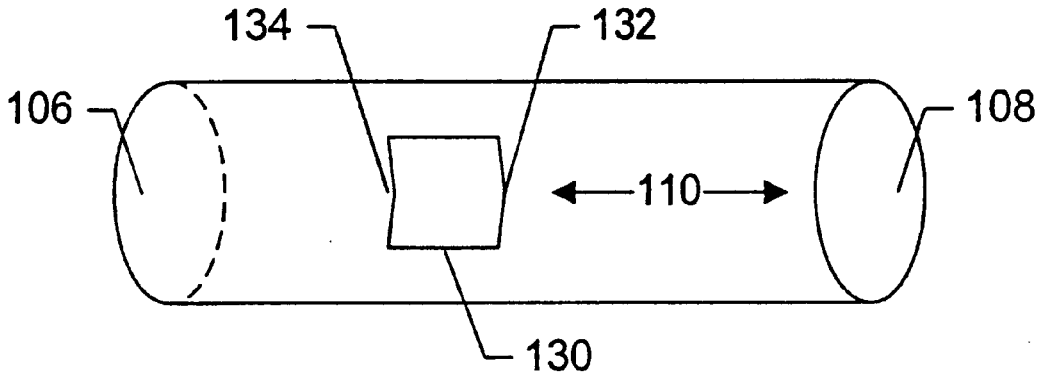
FIG. 6 depicts a cylindrical chamber which includes an opening for air removal.

The chamber may include an opening 130 to allow microwave radiation to enter the chamber, depicted in FIG. 6. The opening 130 may be formed at any location along the body 112. In one embodiment, the opening 130 is formed in a bottom portion of the body 112. The opening is, in one embodiment, positioned in the center of the body. The opening 130 may be positioned at any point along the longitudinal axis of the chamber. The opening is, in one embodiment, configured to match the power of the microwaves entering the chamber. Typically, this condition will require that the opening be narrower than the height of the waveguide. The opening is, in one embodiment, rectangular in shape. The broadwalls 132 and 134 of the rectangular opening may be oriented perpendicular to the longitudinal axis 110 of the cylinder. The broadwalls may be orientated in a perpendicular position to allow the incoming microwave radiation to have the proper orientation to form the transverse magnetic resonance mode.

One example of a resonance mode for drying coated materials is a $TM_{110}$ resonant mode. This particular mode has the characteristic that it provides a uniform electric field intensity along the longitudinal axis of the chamber and across the coated material. The electric field regions 180 and 182 are depicted in FIG. 5 as semi-circular lines extending from the elongated member 114. The intensity of the electric field regions produced by this mode tends to vary between the outer surface 115 of the elongated member and the inner surface 113 of the cavity. Typically, this mode produces an electric field region having a peak intensity at a portion of the surface of the elongated member. Moving along a line 121 from the elongated member 114 to the inner surface 113 of the chamber, the strength of the electric field region is at a maximum at the surface 115 of the elongated member. The strength of the electric field region will decrease as the inner surface 113 is approached. In one embodiment, the chamber has a diameter such that the strength of the electric field as it approaches the inner surface becomes small and shifts its phase by about $\pi/4$ radians. Thus, the chamber is, in one embodiment, sized such that the electric field is substantially completely contained within the chamber. Since the slots are cut in the direction of current flow in the walls, this configuration may allow various slots and openings to be formed within the body of the chamber such that no significant leakage of microwave radiation occurs through these openings.

The $TM_{110}$ resonant mode stores a large amount of electrical energy within a region of the cavity. In one embodiment, the chamber is configured such that the electric field is created having a pattern as depicted in FIG. 5. FIG. 5 depicts a cross-sectional view of the chamber looking along the longitudinal axis of the chamber. Two lobes 180 and 182 represent the distribution of the electric field within a chamber configured to produce a $TM_{110}$ resonant mode. The electric field extends from the surface of the elongated member up to the outer electric field lines 184 and 185. The area beyond electric field lines 184 and 185 represents regions in which there is an electric field of smaller magnitude, but of phase shifted by $\pi/4$ radians. While the electric field varies between the elongated member and the inner surface, the electric field strength is uniform along the longitudinal axis of the cylinder (i.e., in a direction extending into the figure). The strength of the electric field varies such that the maximum field strength is at the surface of the elongated member at locations 181 and 183.

The use of a microwave electromagnetic resonant mode, such as the $TM_{110}$ mode, may allow the drying of coated materials. A coated material 140 may be passed through the chamber such that the material passes through the regions of high electric field strength 181 and 183. The energy imparted in these regions is believed to cause the solvent molecules to become heated and evaporate. Since the peak intensity of the electric field is along the surface of the elongated member the solvents contained within the web may be rapidly heated. The rapid heating of the solvent molecules cause the molecules to evaporate from the coated material. For example, a coated web which has been coated with a water-based coating material may be dried, within a $TM_{110}$ resonant mode chamber, in a time period of about 1 second or less. In comparison, the same web material may take from 10 to 60 seconds to dry within a conventional hot air drying system. By rapidly drying the web in a cavity having a relatively small volume the amount of contaminated effluent air may be minimized, allowing more economical treatment of the air stream.

Another aspect of the $TM_{110}$ mode is that there is no significant electric field produced within the elongated member 114. The electric field, as depicted in FIG. 5, extends out from the elongated member toward the inner surfaces, but does not significantly penetrate the elongated member 114. A substantially rigid member 175 may be inserted within the elongated member 114. The rigid member 175 may have a dielectric constant which is significantly greater from that of the elongated member 114 such as a metal. The rigid member 175 may be inserted within the non-conductive and low loss dielectric elongated member 114 without having any significant effect on the resonance mode, since the electric field does not penetrate into the elongated member.

Insertion of a rigid member within an elongated member is particularly useful during coated web operations. When a coated web is passed along the elongated member the force imparted by the web on the elongated member tends to distort the shape of the member, particularly when the member is made of a plastic such as polytetrafluoroethylene. This distortion may disrupt the preferred resonance mode formed within the chamber. The distortion may also cause undesirable modes to be produced within the chamber. The insertion of a rigid member may help to prevent distortion of the elongated member. Because there is no significant electric field produced within the elongated member the rigid member may be made of a conductive metal material. The rigid member may be made of a relatively inflexible material such as aluminum or steel.

The mode produced in the chamber may be varied by altering the dimensions of the chamber. The chamber, in one embodiment, includes a body made of an upper portion 150 and a lower portion 160 as depicted in FIG. 4. The upper portion 150 and lower portion 160 may be configured such that the volume of the cavity formed by the upper and lower portion may be altered. In one embodiment, the upper portion and lower portion are connected such that the upper portion may be rotated away from the lower portion to vary the volume of the cavity. By varying the volume of the cavity the resonant mode within the chamber may be adjusted. Varying the volume of the cavity allows the cavity to be tuned to the appropriate mode during use.

In an alternate embodiment, the resonant mode within the chamber is not $TM_{110}$. Instead, the mode is $TM_{010}$. An advantage of this mode is that the maximum of the fields are in the center. This may be useful in an embodiment in which the web passes directly through the cavity with no elongated member.

The cavity may include an opening 190 to allow air to pass out of the cavity, as depicted in FIG. 5. A conduit 192 may be coupled to the opening, the conduit leading to an air intake system 194. The air intake system is designed to pull air away from the chamber and into an air treatment system. The air intake system 194 may include a blower which draws air from the chamber. The blower may pull air from the cavity through the opening 190 and into a conduit. Once in the conduit, the air stream may be conducted to an air treatment system. The blower may pull clean air into the chamber through slots 120 and 122. This flow of air may inhibit solvent produced by the drying process from flowing out of the chamber through the slots. A cover including an array of holes may be placed over the opening. The holes are, in one embodiment, sized to inhibit microwaves from entering the opening 190, while allowing air to pass into the opening.

The opening 190 may be positioned at any position within the walls or body of the chamber. In one embodiment, the opening 190 is positioned at a location no higher than the lower slot 120. When opening 190 is so positioned, the air path between the slot 120 and the opening 190 is may be shorter than the air path between the slot 122 and the opening 190. The air flow between slot 120 and the opening 190 may be faster than the air flow from slot 122 and opening 190. When the coated material is a continuous web material, this positioning of the opening may assist the rapid drying of the web material. Typically, the bottom surface of a coated web material collects more solvent than an upper surface of the web. By shortening the air flow path between slot 120 and opening 190 a faster flow of air may be imparted to this bottom surface. This faster air flow may increase the rate at which the web material is dried.

The chamber may be sized to maximize the concentration of the solvent in the effluent air stream. During a typical procedure, air is passed through the slots, across the drying coated material and out the opening 190. By controlling the flow rate and using a chamber of minimal volume, the concentration of solvent contained in the air may be maximized. By maximizing the concentration of solvent within the effluent air stream, the sol vents may be removed from the air stream by recovery of the solvents, or through a destructive abatement process.

When the coated material is a continuous web material, the input and output angles of the web may be controlled to allow the web to pass through the region of highest electrical field strength. When a $TM_{110}$ mode is used the electric field typically has a pattern as depicted in FIG. 5. The two lobes 180 and 182 are formed extending from the elongated member 114. The angular position of these lobes may be determined by the location of the waveguide. In FIG. 5, an opening 192 may be formed to allow waveguide 194 to introduce microwave radiation into the chamber. Typically, the electric field lobes 180 and 182 a re formed in alignment with this opening 192. The lobes are oriented such that a diameter line extending from the center of the waveguide 194 extends through the center of each of the lobes 180 and 182. The regions of the lobes in which the electric field strength is at a maximum, regions 181 and 183, are also aligned along a diameter line extending from the waveguide 194.

To maximize the drying of the web, the slots 120 and 122 may be configured to allow the web to pass through regions 181 and 183. Inlet slot 120 may be oriented at an angle ranging from about 22 degrees to about 90 degrees with respect to the waveguide. Outlet slot 122 may be oriented at an angle ranging from about 90 degrees to about 135 degrees with respect to the waveguide. With the slots oriented at these angles, the web may pass through the electric field regions 181 and 183. Thus, a relatively large (e.g., maximum) amount of energy may be imparted to the web material as it passes through the chamber.

Figure 7:
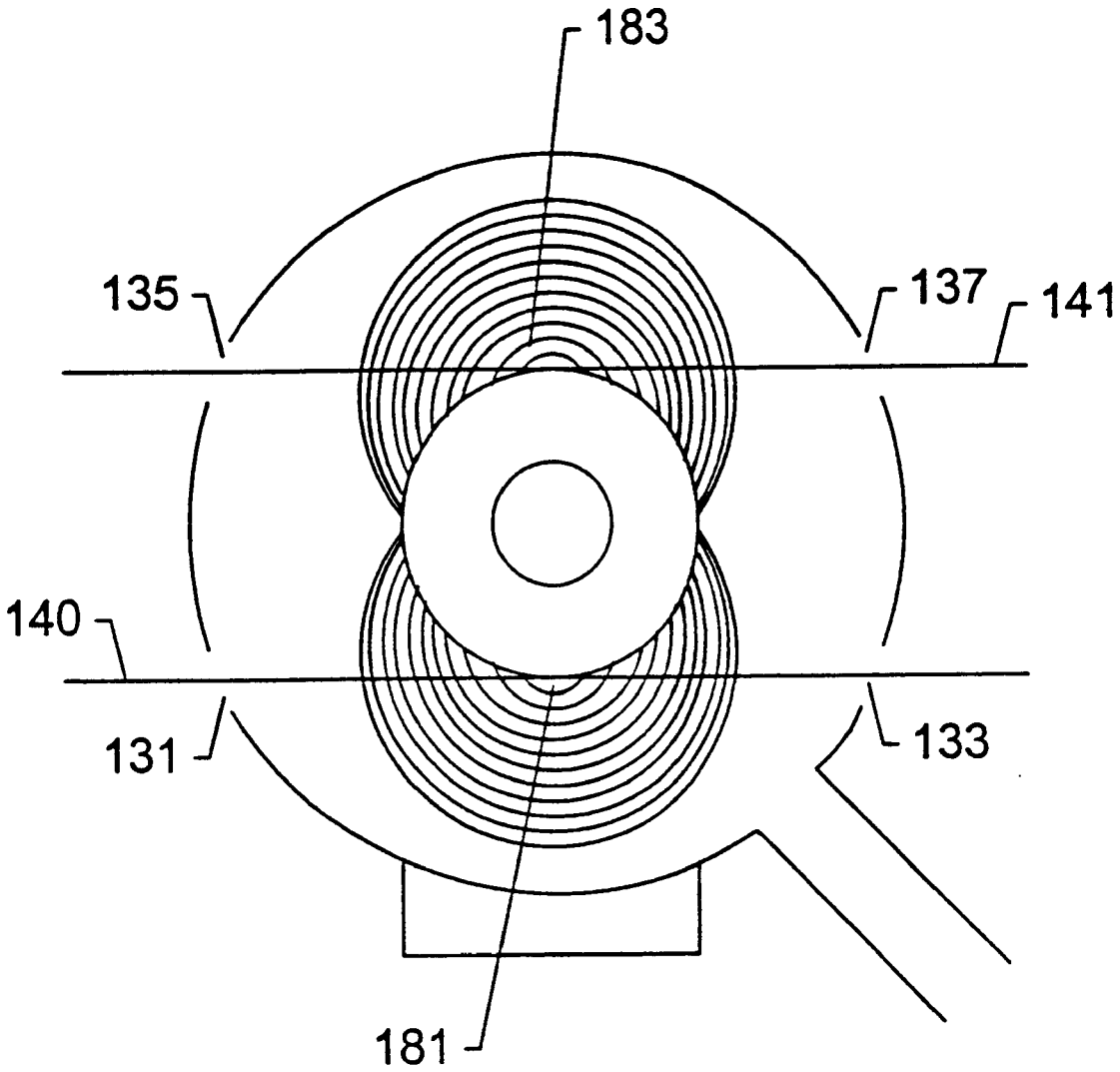
FIG. 7 depicts a cross-sectional view of a chamber, viewed along the longitudinal axis of the chamber, with the slots oriented to allow a straight through passage of the web material.

In another embodiment, depicted in FIG. 7, the slots may be oriented such that the web passes completely through the chamber, exiting from a side opposite to the side through which the web entered the cavity. When a $TM_{010}$ mode is used, the electric field has the pattern depicted in FIG. 7. To maximize the drying of the web, the slots 131 and 133 may be configured to allow the web 140 to pass through electric field region 181. The slots may be positioned such that the web passes through the cavity along a substantially straight path. Additional slots 135 and 137 may be present to allow a web 141 (which may or may not be the same as web 140) to pass through electric field region 183. Additional slots 135 and 137 may be useful for treating coated materials placed upon a conveyer belt system. Coated materials, such as semiconductor wafers, may be conveyed through the system upon the web 140 or web 141, allowing the coated materials to pass through the electric field region 183. An advantage of a straight path system is that the web may not deform elongated member 114 as much as during a semicircular travel path. By minimizing the deformation of the elongated member, electromagnetic mode changes may be minimized.

When the chamber is operated in the $TM_{x10}$ mode, where x is any integer, the leakage of microwaves through the slots is typically minimal. As noted before, the $TM_{110}$ creates two electric field lobes that are substantially contained within the chamber. The strength of the electric field decreases as the nodes approach the inner surface of the chamber. At the inner surface no significant electric field exists. Thus, microwave radiation does not significantly leak out of these openings. When other electromagnetic resonance modes are used, the slots may be configured to prevent the leakage of microwave radiation. The slots may be made sufficiently narrow to allow the passage of a coated web material through the slots, while preventing the leakage of microwaves from the chamber.

The chamber, as described above, is capable of producing a resonant mode having a relatively high energy level. This energy level may be chosen such that the energy removed by drying the coated material is less than the total energy supplied by the microwave generator. In one embodiment, the power is set such that a steady state may be achieved whereby the amount of energy removed by the web is replaced by the incoming energy such that the energy of the system remains constant.

Figure 8:
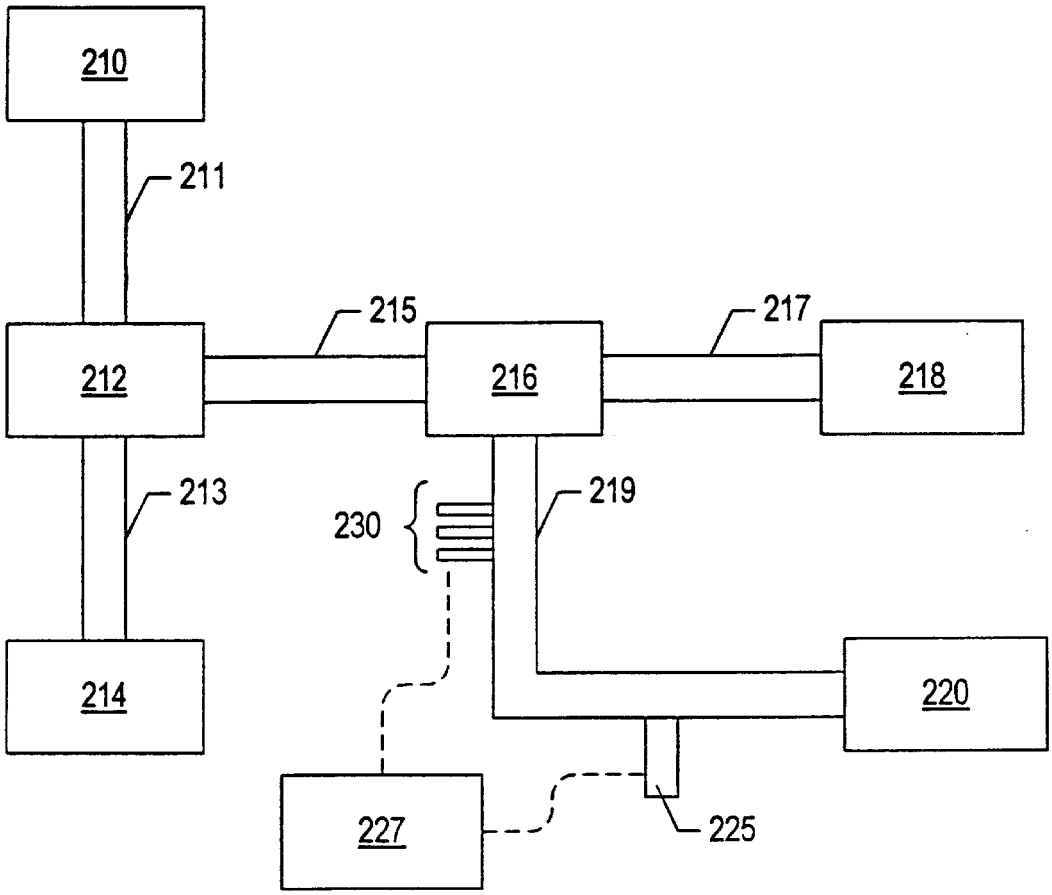
FIG. 8 depicts a microwave generator coupled to the applicator through a power regulating system.

An embodiment of a microwave drying system is shown in FIG. 8. The microwave drying system includes a microwave generator 210 for generating microwave radiation. The generator, in one embodiment, produces microwave radiation having a power of about 2 kilowatts ("kW") at 2450 Megahertz ("MHz") or 915 MHz.

The microwave generator 210 may include a controller for varying the output power of the generator. The controller may be used to select the appropriate output power of the microwave generator. In another embodiment, the microwave generator may be designed to produce microwave radiation having the desired power.

For drying purposes, the microwave radiation would typically be at a power of about 2 kW at a frequency of 2450 MHz or 915 MHz for a coated material having a width of 24 inches, and proportionally higher for larger web widths. The setting of the power level at this level is preferred to prevent excessive heating of the coated material due to the heating of the solvent. The power may be adjusted by adjusting a controller on the microwave generator.

In another embodiment, the power of the microwave radiation produced by the microwave generator 210 may be adjusted by passing the microwaves through a power reduction system including a series of circulators and loads to lower the power of the microwave radiation to the appropriate level. Referring to FIG. 8, the microwave radiation generated by microwave generator 210 may be passed through a waveguide 211 to ferrite circulator 212. The waveguide segment 211, along with segments 213, 215, 217, and 219, may have any number of cross-sectional geometries (e.g., square, circular, rectangular, etc.). In one embodiment, the waveguide segments 211, 213, 215, 217, and 219 are rectangular in cross-section and made of aluminum.

The ferrite circulator 212 may be configured to split the microwave radiation such that the radiation travels along waveguide 213 and 215. The microwaves passing along waveguide 213 are transferred to load 214. Load 214 absorbs the energy of the microwaves which reach the load. The load may contain water or another suitable microwave absorbing medium. By splitting the microwave radiation in this manner, the power of the radiation is controlled. An additional ferrite circulator 216 and load 218 may be used to further control the power of the microwave radiation.

In another embodiment, the microwave generator may produce microwave radiation at the appropriate power level without the need of a power reduction system. The microwave generator may be connected directly to the drying chamber.

The system of FIG. 8 may include a microwave energy sensor 225 which measures the power of the microwave radiation reflected in the waveguide 219. The energy sensor 225 may be connected to an automatic control system 227 so that the control system varies (tunes) the power of the microwave radiation as a function of the information received from the microwave energy sensor 225. A series of microwave absorbing rods 230 may be positionable within the waveguide to vary the energy of the microwaves passing through waveguide 219. The microwave absorbing rods 230 may be manually positioned or automatically positioned by the use of a motorized piston. The motorized piston may be connected to the automatic control system 227 to allow the control system to tune the power of the microwaves in response to the energy measured by the microwave energy sensor 225.

Figure 9:
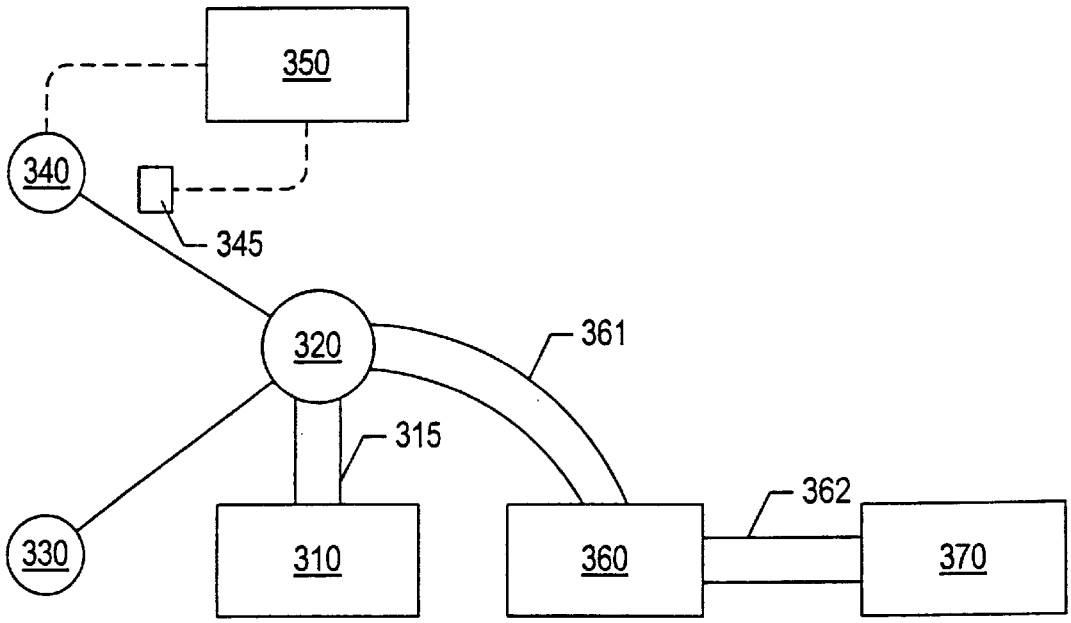
FIG. 9 depicts a system for drying a coated web material.

A system for drying a continuous coated web material is depicted in FIG. 9. The system includes a feed roller 330, a collection roller 340, a chamber for drying the web 320 and a microwave generator 310. The microwave generator is coupled to the drying chamber 320 via conduit 315. The microwave generator may be coupled to a power reduction system as shown in FIG. 8. The feed roller 330 holds the coated web material which is to be treated. The collection roller 340 holds the dried coated web material. The collection roller may be attached to a motor which rotates the collection roller 340 to move the web material through the drying chamber 320. The motor is, in one embodiment, configured to rotate the collection roller such that the web may be passed thought the chamber at speeds up to about 500 feet per second.

A microwave drying system may be used to dry a coated material. A variety of coated materials may be dried with the system described above, including but not limited to wall coverings (e.g., wallpaper), plastic and paper packaging, published materials, textiles, photographic films, plastic transparencies, adhesive tapes, transfer print paper, and semiconductor materials. These materials are typically coated with coatings that have been dissolved in water or a VOC. Examples of VOCs include but are not limited to methyl ethyl ketone, acetone, toluene, alcohols, and chlorinated solvents. In general, VOCs include solvents which have boiling points that are less than about 150° C. To complete the coating process, the solvent may be removed from the coated material, leaving the desired coating on the material.

FIG. 9 depicts a typical system for drying a coated web material. The coated web material which includes solvent to be removed from the material may be placed on the feed roller 330. Alternatively, a dry uncoated web material may be loaded onto the feed roller. Prior to entering the drying chamber 320, the web may be coated.

In a typical procedure the microwave generator 310 is turned on and the microwaves are introduced into the chamber 320 such that a electromagnetic resonant mode is produced within the chamber. In one embodiment, a transverse magnetic mode is produced; preferably, a $TM_{110}$ mode is produced. The microwave generator may have to be tuned in order to produce microwaves having the appropriate power to produce the desired resonance mode. Tuning may be accomplished in the manner previously described. In addition to tuning of the incoming microwaves, the volume of the cavity may also be adjusted to produce the desired resonant mode.

The web may be pulled through the chamber by rotation of the collection roller 340. The rate at which the web material passes through the material may be controlled by the automatic controller 350. Automatic controller 350 may be connected to web sensor 345, which is configured to determine e.g., the temperature, dryness and/or the solvent content of the coated web material exiting the chamber. If the web material contains significant amounts of solvent, the controller may reduce the speed of the collection roller 340 to increase the time the web material remains within the chamber.

The sensor 345 may also be configured to measure a temperature of the exiting web material. If the temperature of the web material is too high, deterioration of the web material may occur. To reduce this deterioration the automatic controller 350 may increase the speed of the collection roller 340 to decrease the time the web material remains within the chamber.

The evaporated solvent may be contained within the cavity after the solvent is removed. An air intake system 360 may be connected to the chamber such that the air within the chamber is drawn toward the air intake system 360 along conduit 361. In one embodiment, the air intake system includes a blower. The contaminated air stream is then passed through the air intake system 360 and into the conduit 362. Conduit 362 may be connected to an air treatment system 370.

The drying chamber may also be used for the drying of semiconductor wafers. Typically, semiconductor wafers, in the form of a disk, are dried by mounting the wafers upon a rotatable platform. This platform is typically rotated at high speeds while a stream of nitrogen is passed over the wafer to remove the solvents. Such a system tends to produce a large amount of contaminated air. Additionally, the nitrogen stream may introduce impurities onto the wafer. These impurities may compromise the integrity of these devices.

In another embodiment, silicon wafers or other coated materials may be placed within the chamber prior to introducing microwaves into the chamber. After the chamber has been closed, the microwave generator may be turned to produce the resonant mode within the cavity. The silicon wafer may be placed perpendicular to the axis of the cylinder. When a $TM_{110}$ mode is excited within the cavity the silicon wafer may be located upon the elongated member such that a portion of the wafer passes through the strongest portion of the electrical field. The wafer may be rotated such that the entire wafer passes through the strongest portion of the electric field. This process has the advantage that the drying of the wafer may be performed in a clean room environment, thus minimizing the introduction of impurities onto the silicon wafer.

A drying process, similar to the above-described method, may be used for the drying of sheet fed paper in printing devices. A chamber may be located within the printing device such that the printed paper may be dried within a microwave resonant chamber. The chamber may be incorporated into devices such as photocopiers, facsimile machines, and computer printers. The microwave drying chamber may be used for toner- and ink-based printing devices.

The microwave drying system herein described may exhibit several important practical advantages over conventional drying methods. A resonant chamber of this type may be very compact. This may allow the chamber to be located near the point of application of the coating. The microwave resonant cavity is relatively small in diameter, an d may be placed close to the coating station, minimizing loss of volatile compounds into the ambient air. Because the electric field intensities within the cavity are very high, rapid "flash drying" may be achieved, permitting the system to run at high line speeds. Furthermore, a minimal airflow may be required to prevent recondensation of the solvent vapors. Thus, a rapid drying unit with close, low-dilution capture of VOCs may be feasible, making it possible to treat VOCs and possibly recover them for reuse much more economically than is possible with current technology.

Other advantages may include reduced drying times. Drying times for coatings, even difficult ones such as water-borne coatings, can be reduced from minutes to seconds. For most web materials (e.g., paper, plastics and textiles) little heating of the substrate may occur, minimizing problems with substrate distortion and heat degradation. Finally, the system may be retrofitted into existing printing and coating equipment.

Further modifications and alternative embodiments of various aspects of the invention will be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

What is claimed is:

1. A chamber for producing a resonant electromagnetic mode when microwave radiation is introduced into the chamber, comprising:

a body, the body comprising an inner surface, the inner surface comprising a substantially conductive material;

a front wall and a rear wall, both the front and rear walls comprising inner surfaces, wherein the inner surfaces of the front and rear walls comprise a substantially conductive material, and wherein the front and rear walls are configured to be substantially reflective of microwaves;

an elongated member oriented in a central portion of the chamber, the elongated member comprising a substantially low loss dielectric material;

wherein the body, the front wall, and the rear wall together define a cavity, and wherein an interior volume of the cavity and a volume of the elongated member are predetermined such that the interaction of the microwave radiation with the body, the front and rear walls, and the elongated member produces the resonant electromagnetic mode during use.

2. The chamber of claim 1 wherein the electromagnetic mode is a transverse magnetic mode.

3. The chamber of claim 1 wherein the electromagnetic mode is a $TM_{110}$ mode.

4. The chamber of claim 1 wherein the elongated member comprises a second elongated member running through a center portion of the elongated member along a longitudinal axis of the elongated member, the second elongated member comprising a substantially rigid metal.

5. The chamber of claim 1 wherein the electromagnetic mode comprises an electric field component, wherein the chamber is configured such that a strength of the electric field is variable, and wherein the strength of the electric field is at a maximum value proximate an outer surface of the elongated member.

6. The chamber of claim 1 wherein the electromagnetic mode comprises an electric field component, and wherein the chamber is configured such that a strength of the electric field is substantially uniform along a longitudinal axis of the elongated member.

7. The chamber of claim 1 wherein the cavity is configured such that a $TM_{110}$ mode is produced at a significantly greater magnitude than the other modes when the cavity is irradiated with microwave radiation.

8. The chamber of claim 1 wherein the inner surface encloses two slots formed therein, the slots being configured to allow a web material to pass through the chamber.

9. The chamber of claim 1 wherein a portion of the inner surface encloses an opening formed therein, the opening being configured to allow air to pass through the chamber.

10. The chamber of claim 1 wherein the chamber is made of aluminum.

11. The chamber of claim 1 wherein the interior cavity is substantially cylindrical, and wherein the elongated member is substantially cylindrical.

12. The chamber of clam 1, further comprising a lower section, an upper section, and a connector, the lower section configured to join with the upper section to form the interior cavity, the connector configured to couple the lower section to the upper section such that a front edge of the upper section is movable away from a front edge of the lower section.

13. The chamber of claim 1 wherein the elongated member comprises polytetrafluoroethylene.

14. The chamber of claim 1, further comprising a lower section, an upper section, and a connector, the lower section configured to join with the upper section to form the interior cavity, the connector configured to couple the lower section to the upper section such that a front edge of the upper section is movable away from a front edge of the lower section, and wherein the movement of the upper section allows a width of the interior cavity to change such that the resonant mode of the cavity may be altered.

15. A system for drying coated materials with microwave radiation, comprising:

a chamber for receiving the coated material, the chamber configured to produce a resonant electromagnetic mode when microwave radiation is introduced into the chamber such that the microwave radiation substantially dries at least a portion of the coated material, comprising:

a body, the body comprising an inner surface, the inner surface comprising a substantially conductive material; and a front wall and a rear wall, both the front and rear walls comprising inner surfaces, wherein the inner surfaces of the front and rear walls comprise a substantially conductive material, and wherein the front and rear walls are configured to be substantially reflective of microwaves;

wherein the body, the front wall, and the rear wall together define a cavity, and wherein an interior volume of the cavity and a volume of the elongated member are predetermined such that the interaction of the microwave radiation with the body, the front and rear walls, and the elongated member produces the resonant electromagnetic mode during use; and a microwave generator for generating the microwave radiation during use.

16. The system of claim 15, further comprising an elongated member oriented in a central portion of the chamber, the elongated member comprising a substantially low loss dielectric material.

17. The system of claim 15 wherein the electromagnetic mode is a transverse magnetic mode.

18. The system of claim 15 wherein the electromagnetic mode is a $TM_{010}$ mode.

19. The system of claim 15 wherein the electromagnetic mode is a $TM_{210}$ mode.

20. The system of claim 15 wherein the electromagnetic mode comprises an electric field component, and wherein the chamber is configured such that the electric field is oriented along a longitudinal axis of the elongated member.

21. The system of claim 15 wherein the electromagnetic mode comprises an electric field component, and wherein the chamber is configured such that a strength of the electric field is at a minimum value proximate the inner surface.

22. The system of claim 15 wherein the electromagnetic mode comprises an electric field component, wherein the chamber is configured such that a strength of the electric field is variable, and wherein the strength of the electric field is at a maximum value at an outer surface of the elongated member.

23. The system of claim 15 wherein the electromagnetic mode comprises an electric field component, and wherein the chamber is configured such that a strength of the electric field is substantially uniform along a longitudinal axis of the elongated member.

24. The system of claim 15 wherein the electromagnetic mode comprises an electric field component, and wherein the chamber is configured such that a strength of the electric field is at a minimum value within the elongated member.

25. The system of claim 15 wherein the electromagnetic mode comprises an electric field component, wherein the chamber is configured such that a strength of the electric field is at a first minimum value proximate the inner surface, and wherein the strength of the electric field increases in a direction towards the elongated member such that the strength reaches a maximum value at an outer surface of the elongated member, and wherein the strength of the electric field is at a second minimum value within the elongated member.

26. The system of claim 25 wherein the first minimum value and the second minimum value are about zero.

27. The system of claim 15 wherein the cavity is configured such that a $TM_{110}$ mode is produced as the mode with the largest amplitude when the cavity is irradiated with microwave radiation.

28. The system of claim 15 further comprising two slots formed through the inner surface, the slots configured to allow the coated material to pass through the chamber.

29. The system of claim 15 further comprising an opening formed through a portion of the inner surface, the opening configured to allow air to pass through the chamber.

30. The system of claim 15 wherein the chamber is made of aluminum.

31. The system of claim 15 wherein the inner surface comprises an inner conductive layer, wherein the inner layer comprises gold, silver or copper.

32. The system of claim 15 wherein the interior cavity is substantially cylindrical, and wherein the elongated member is substantially cylindrical.

33. The system of claim 15 wherein the interior cavity is substantially cylindrical, and wherein the interior width is between about 0.5 to about 3 meters, and wherein the elongated member is substantially cylindrical.

34. The system of clam 15, further comprising a lower section, an upper section, and a connector, the lower section configured to join with the upper section to form the interior cavity, the connector configured to couple the lower section to the upper section such that a front edge of the upper section is movable away from a front edge of the lower section.

35. The system of claim 15 wherein an energy of the microwave radiation contained within the chamber is substantially constant during use.

36. The system of claim 15 wherein the elongated member is made of a dielectric material whose dielectric properties maintain the desired TM mode within the cavity.

37. The system of claim 36 wherein the dielectric material comprises polytetrafluoroethylene, quartz, or duroid.

38. The system of claim 15 wherein the elongated member is made of a material having a low loss dielectric constant.

39. The system of claim 15 wherein the microwave generator generates microwave radiation having a frequency of about 2000–3000 MHz.

40. The system of claim 15 wherein the microwave generator generates microwave radiation having a frequency of about 600–1200 MHz.

41. The system of claim 15 wherein the elongated member comprises a second elongated member running through a center portion of the elongated member along a longitudinal axis of the elongated member, the second elongated member made of a substantially rigid metal.

42. The system of clam 15, further comprising a lower section, an upper section, and a connector, the lower section configured to join with the upper section to form the interior cavity, the connector configured to couple the lower section to the upper section such that a front edge of the upper section is movable away from a front edge of the lower section, and wherein the movement of the upper section allows a width of the interior cavity to change such that the resonant mode of the cavity may be altered.

43. The system of claim 15, further comprising a waveguide coupling the microwave generator to the chamber, wherein the waveguide is substantially rectangular.

44. The system of claim 15 further comprising a waveguide coupling the microwave generator to the chamber, wherein the waveguide is substantially rectangular, the waveguide comprising a pair of broadwalls oriented on opposing sides of the waveguide, and wherein the waveguide is coupled to the chamber such that the broadwalls are substantially perpendicular to the longitudinal axis of the chamber.

45. The system of claim 15, further comprising an opening formed through a portion of the inner surface, the opening configured to allow air to pass through the chamber, and further comprising an air intake system, the air intake system coupled to the opening, wherein the air intake system is configured to draw air out of the chamber and into the air intake system.

46. The system of claim 15 further comprising an opening formed through a portion of the inner surface, and further comprising an air intake system coupled to the opening, wherein the air intake system is configured to draw the solvent from the chamber during use while maintaining a safe operating condition with respect to the concentration of combustible vapors within the chamber.

47. The system of claim 15 wherein the coated material is wallpaper.

48. The system of claim 15 wherein the coated material is print transfer paper.

49. The system of claim 15 wherein the coated material is a coated plastic web.

50. The system of claim 15 wherein the coated material is a semiconductor wafer.

51. The system of claim 15 wherein the coated material is a coated web, and further comprising a web transfer system for moving the web through the chamber, and further comprising an automatic controller for controlling a speed which the coated material passes through the chamber.

52. The system of claim 15 further comprising an automatic control system configured to vary the microwave radiation such that the desired electromagnetic mode is produced.

53. The system of claim 15 wherein the solvent is water.

54. The system of claim 15 wherein the solvent is a volatile organic compound.

55. The system of claim 15 wherein the chamber is configured to fit onto a coated web printing system.

56. The system of claim 15 wherein the chamber is configured to fit within an ink-based printing device.

57. The system of claim 15 wherein the elongated member is configured to be substantially rotatable about a longitudinal axis of the chamber.

58. The chamber of claim 1, wherein the electromagnetic mode comprises an electric field component, and wherein the chamber is configured such that the electric field is oriented along a longitudinal axis of the elongated member.

59. The chamber of claim 1 wherein the electromagnetic mode comprises an electric field component, and wherein the chamber is configured such that a strength of the electric field is at a substantially minimum value proximate the inner surface.

60. The chamber of claim 1 wherein the electromagnetic mode comprises an electric field component, and wherein the chamber is configured such that a strength of the electric field is at a substantially minimum value within the elongated member.

61. The chamber of claim 1 wherein the electromagnetic mode comprises an electric field component, wherein the chamber is configured such that a strength of the electric field is at a first minimum value proximate the inner surface, and wherein the strength of the electric field increases in a direction towards the elongated member such that the strength reaches a substantially maximum value at an outer surface of the elongated member, and wherein the strength of the electric field is at a second minimum value within the elongated member.

62. The chamber of claim 61 wherein the first minimum value and the second minimum value are about zero.

63. The chamber of claim 1 wherein the cavity is configured such that a $TM_{110}$ mode is produced as the mode with the largest amplitude when the cavity is irradiated with microwave radiation.

64. The chamber of claim 1 wherein the inner surface comprises an inner conductive layer, wherein the inner layer comprises gold, silver or copper.

65. The chamber of claim 1 wherein the interior cavity is substantially cylindrical, and wherein the elongated member is substantially cylindrical.

66. The chamber of claim 1 wherein the interior cavity is substantially cylindrical, and wherein the interior width is between about 0.5 to about 3 meters, and wherein the elongated member is substantially cylindrical.

67. The chamber of claim 1 wherein the elongated member is made of a dielectric material whose dielectric properties maintain the desired TM mode within the cavity.

68. The chamber of claim 1 wherein the dielectric material comprises polytetrafluoroethylene, quartz, or duroid.

69. A system for drying coated materials with microwave radiation, the coated materials being substantially coated with a solvent, comprising:

a substantially cylindrical chamber for receiving the coated material, the chamber configured to produce a resonant electromagnetic mode when microwave radiation is introduced into the chamber such that the microwave radiation substantially removes the solvent from the coated material during use comprising:

an inner surface, the inner surface comprising a substantially conductive material;

a front and rear wall, both the front and rear walls comprising inner surfaces, wherein the inner surfaces of the front and rear walls comprise a substantially conductive material, and wherein the front and rear walls are configured to be substantially reflective of microwaves;

an elongated member oriented in a central portion of the chamber, the elongated member comprising a substantially non-conductive material;

a slot for allowing the passage of a coated material through the chamber; and an opening configured to allow the removed solvent to pass out of the chamber;

a microwave generator for generating microwave radiation; and a waveguide for conducting the microwave radiation from the microwave generator to the chamber.

* * * * *

UNITED STATES PATENT AND TRADEMARK OFFICE

CERTIFICATE OF CORRECTION

PATENT NO. : 6,207,941 B1
DATED : March 27, 2001
INVENTOR(S) : Philip S. Schmidt, John H. Davis and Tyler Blessing It is certified that error appears in the above-identified patent and that said Letters Patent is hereby corrected as shown below:

Column 18,
Lines 13 and 40, please delete "clam" and substitute "claim"

Signed and Sealed this

Seventh Day of May, 2002

*Attest:*

*Attesting Officer*

JAMES E. ROGAN
*Director of the United States Patent and Trademark Office*